US006941728B1

(12) United States Patent
Bray et al.

(10) Patent No.: US 6,941,728 B1
(45) Date of Patent: Sep. 13, 2005

(54) METHOD AND APPARATUS FOR FORMING A MULTIPLE BUNDLE HINGED LID HINGED CIGARETTE PACK

(75) Inventors: Andrew Jonathan Bray, Southampton (GB); Steven Holford, Southampton (GB); Alan Douglas Tearle, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 10/795,775

(22) Filed: Mar. 8, 2004

(51) Int. Cl.[7] ..... B65B 11/58

(52) U.S. Cl. ..... 53/449; 53/447; 53/462; 53/466; 53/234

(58) Field of Search ..... 53/447, 449, 462, 53/466, 234; 131/283; 206/256, 261, 264, 206/268

(56) References Cited

U.S. PATENT DOCUMENTS 1,661,803 A * 3/1928 Kaval ..... 206/261
4,631,900 A * 12/1986 Mattei et al. ..... 53/462
5,058,363 A * 10/1991 Focke et al. ..... 53/462
5,143,213 A * 9/1992 Moore et al. ..... 206/268
5,158,178 A * 10/1992 Cobler ..... 206/256
5,160,023 A * 11/1992 Adams et al. ..... 53/449
5,174,443 A * 12/1992 Chance et al. ..... 53/462
5,174,444 A * 12/1992 Adams et al. ..... 53/462
5,178,270 A * 1/1993 Adams et al. ..... 206/256
5,180,056 A * 1/1993 Adams et al. ..... 206/256
5,193,674 A * 3/1993 Cobler et al. ..... 206/256
5,214,901 A * 6/1993 Milliner ..... 53/447
5,216,870 A * 6/1993 Boriani et al. ..... 53/462
5,461,842 A * 10/1995 Brizzi et al. ..... 53/234
5,473,862 A * 12/1995 Brizzi et al. ..... 53/447
5,588,281 A * 12/1996 Boriani et al. ..... 53/447
5,647,190 A * 7/1997 Minarelli et al. ..... 53/446
5,680,745 A * 10/1997 Brizzi et al. ..... 53/449
5,906,087 A * 5/1999 Boldrini ..... 53/462
6,035,612 A * 3/2000 Draghetti et al. ..... 53/466
6,164,041 A * 12/2000 Focke et al. ..... 53/466
6,223,895 B1 * 5/2001 Bowen et al. ..... 206/256
6,230,966 B1 * 5/2001 Beales et al. ..... 206/434
D492,815 S * 7/2004 Bray et al. ..... D27/189
D495,824 S * 9/2004 Bray et al. ..... D27/189
6,837,369 B2 * 1/2005 Amos ..... 206/273

* cited by examiner

*Primary Examiner*—Louis Huynh
(74) *Attorney, Agent, or Firm*—John F. Salazar; Middleton Reutlinger

(57) ABSTRACT

A method and apparatus for making a hinged lid side by side vertically hinged cigarette pack having a first bundle and a second bundle of cigarettes is described. The machinery includes a first machine to form a first foil wrapped bundle surrounded by a first inner frame, a second machine for forming a second foil wrapped bundle surrounded by a second inner frame and a third machine for combining the first and second foil wrapped bundle into a single hinged lid side by side vertically hinged pack.

31 Claims, 12 Drawing Sheets

METHOD AND APPARATUS FOR FORMING A MULTIPLE BUNDLE HINGED LID HINGED CIGARETTE PACK

BACKGROUND OF THE INVENTION

The present invention is directed towards a cigarette wrapping machine which forms a hinged lid, hinged side by side carton or pack of cigarettes wherein a first foil wrapped bundle is placed in hinged side by side relationship with a second foil wrapped bundle.

SUMMARY OF INVENTION

The system of the present invention provides for a cigarette packing machine, the machine consisting of three separate machines, a first cigarette wrapping machine, a second cigarette wrapping machine and a third cigarette combining machine. The system of the present invention provides for creation of a first and a second foil wrapped inner frame bundle for combining at a subsequent machine which partially surrounds them with an outer frame having a hinged lid. The outer frame member also provides for a side hinge and a separated bottom wall such that each of the individual foil wrap bundles may be hinged along a given adjoining side.

The three machine cigarette packers of the present invention utilizes a first and a second cigarette packer which have similar designs. Each of the first and second cigarette packers or cigarette wrapping machine may be modified according to the desired combination of cigarettes to be eventually wrapped in the hinged lid pack, but in the present design the first and the second cigarette pack are utilized to form a thirteen cigarette bundle and a seven cigarette bundle. The first and the second cigarette packer are of similar design such that initially cigarettes are fed into the packer at an in-feed station. The cigarettes at the in-feed station are then lined up and placed on a cigarette conveyor to be combined as necessary and thereafter fed into the foil wrapping station. The foil wrapping station utilizes foil drawn from a bobbin such that the foil wraps the requisite cigarette bundle as necessary and also applies the necessary perforations along an upper section thereof as is standard practice. Due to the perforations placed in the upper portions of the foil, the upper section of the foil wrap may be removed by the consumer upon initial opening of the cigarette pack. In both the first and the second cigarette packing machine, the foil wrapped bundle is then conveyed to an individual station in a blank conveyor. Prior to insertion of the foil wrapped cigarette bundle into the blank conveyor station, the side walls of the individual cigarette blank are upturned by the appropriate folding mechanism. Additionally, a small dot or placement of adhesive may be utilized to affix the foil wrap cigarette bundle onto the flat face of the cigarette blank. The blank conveyor then conveys the adjoined foil wrapped cigarette bundle and inner carton to the appropriate folding stations. A second spot of adhesive may be placed on the opposing flat planar surface so that the foil wrapped bundle is securely affixed to both the front and back surface of the inner frame carton.

The combined inner frame carton and foil wrapped cigarette bundle is folded appropriately on all sides and adhesive is applied where necessary to assure that the folding flaps maintained their position. The side member folding operation may then take place prior to insertion of the combined inner frame carton and foil wrapped bundle into the heated drying drum.

A third cigarette packing machine is provided which receives the foil wrapped bundles having an inner frame and places an outer frame around the combined face to face positioned foil wrapped bundles to make a hinged lid pack having a vertical side hinge. The bottom panel of the outer frame is cut to allow opening along the hinge line. The pack has a hinged lid and the individual foil wrapped bundles are separable by virtue of the hinge. The third packing machine applies a long hinge panel or flap which is adhesively applied to a side wall of one of the foil wrapped bundles. The hinge panel also has a score or hinge line to allow the individual foil wrapped bundles to hinge.

BRIEF DESCRIPTION OF THE DRAWINGS

This invention may be more clearly understood with the following detailed description and by reference to the respective drawings in which.

DETAILED DESCRIPTION OF THE PREFERRED EMBODIMENTS

Figure 1:
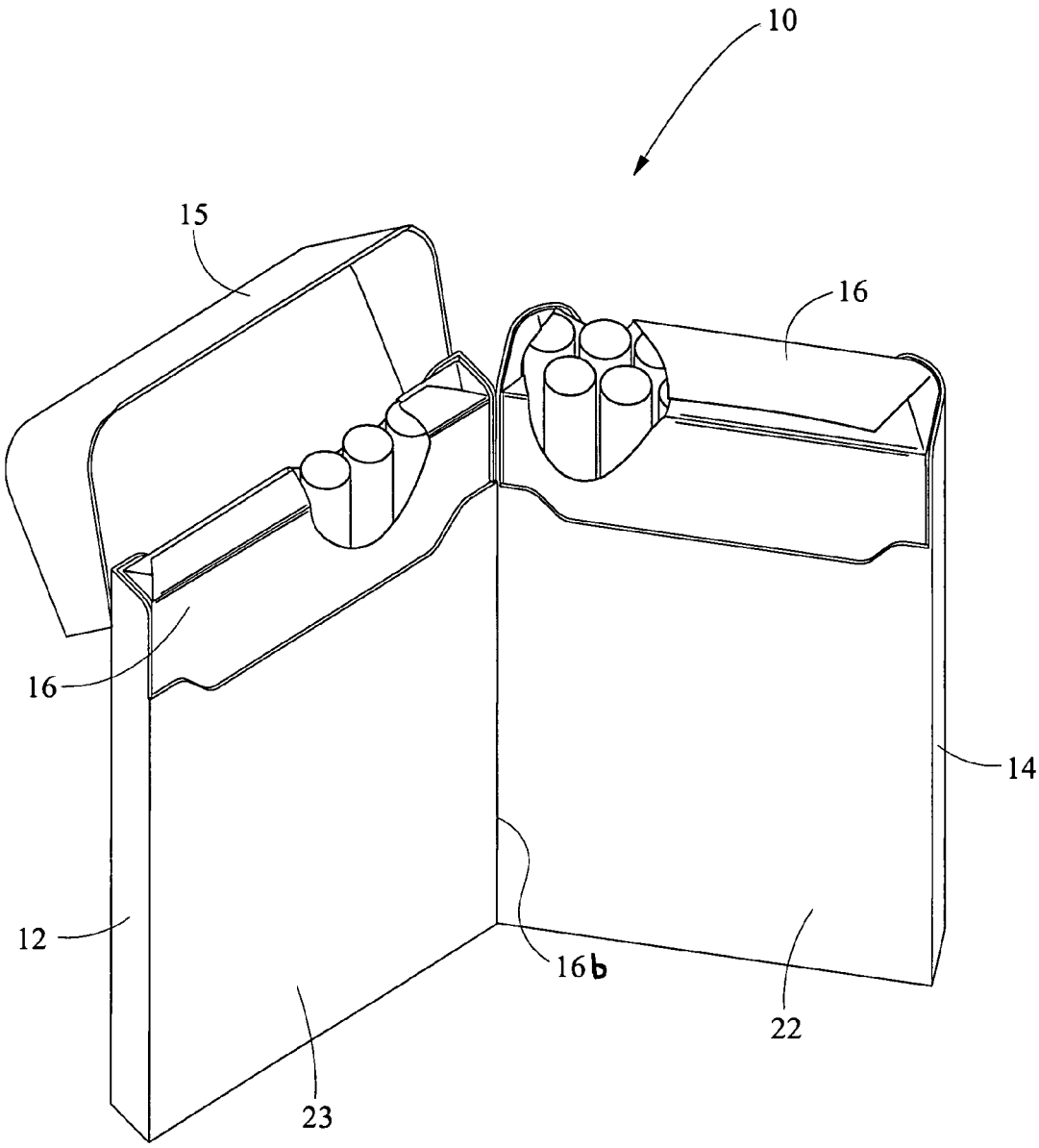
FIG. 1 is a perspective view of the hinged side by side pack of the present invention.
Figure 7:
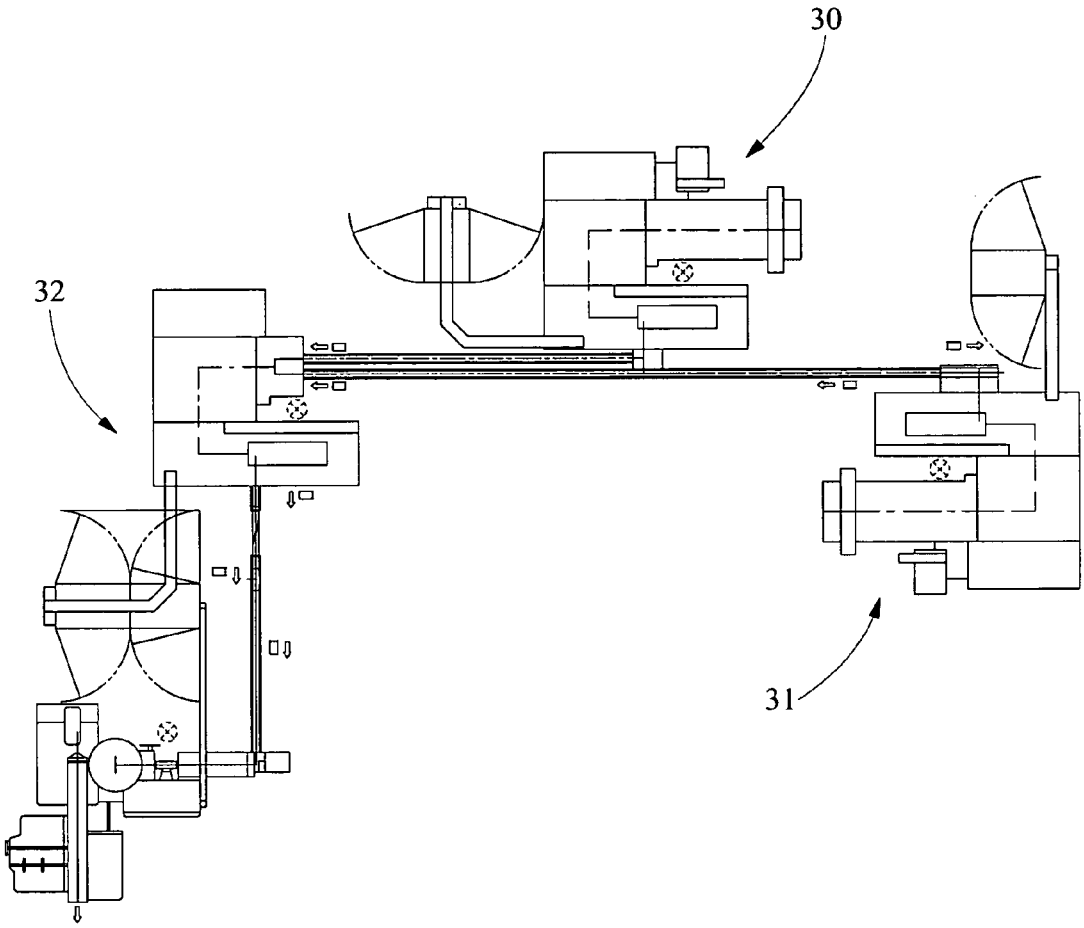
FIG. 7 is a top plan layout view of the cigarette wrapping machines which are part of the invention.
Figure 8:
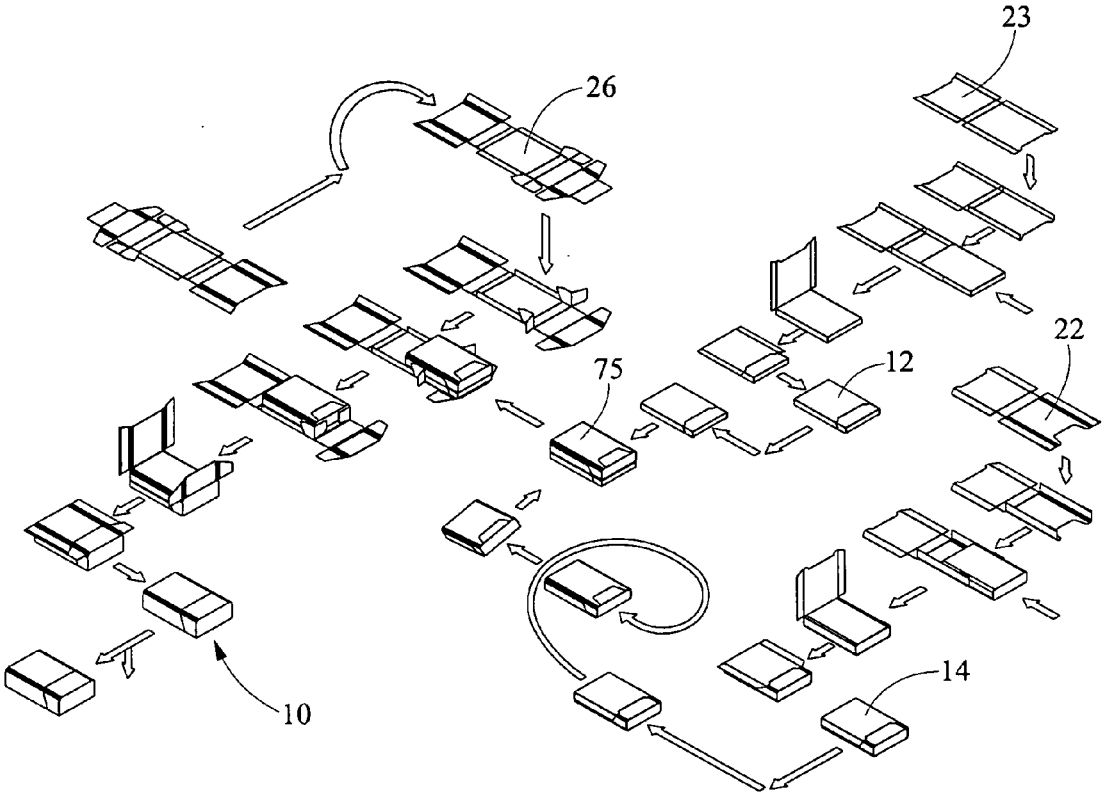
FIG. 8 is a schematic view of the foil wrap bundle paths used in the present invention.

Shown in FIG. 1 is the hinged lid side by side hinged pack 10 of the present invention. The machinery which creates the hinged lid side-by-side hinged cigarette pack 10 is comprised of three different machines, Hinged Lid Packer (HLP1) or first cigarette wrapping machine 30, HLP2 or second cigarette packing machine 31 and HLP3 or third cigarette packing machine 32, shown in FIG. 7. Both of HLP1 30 and HLP2 31 are designed to create individual foil wrapped cigarette bundles which are wrapped in inner frames and then wrapped in an outer frame in the HLP3 32 machine.

Figure 3:
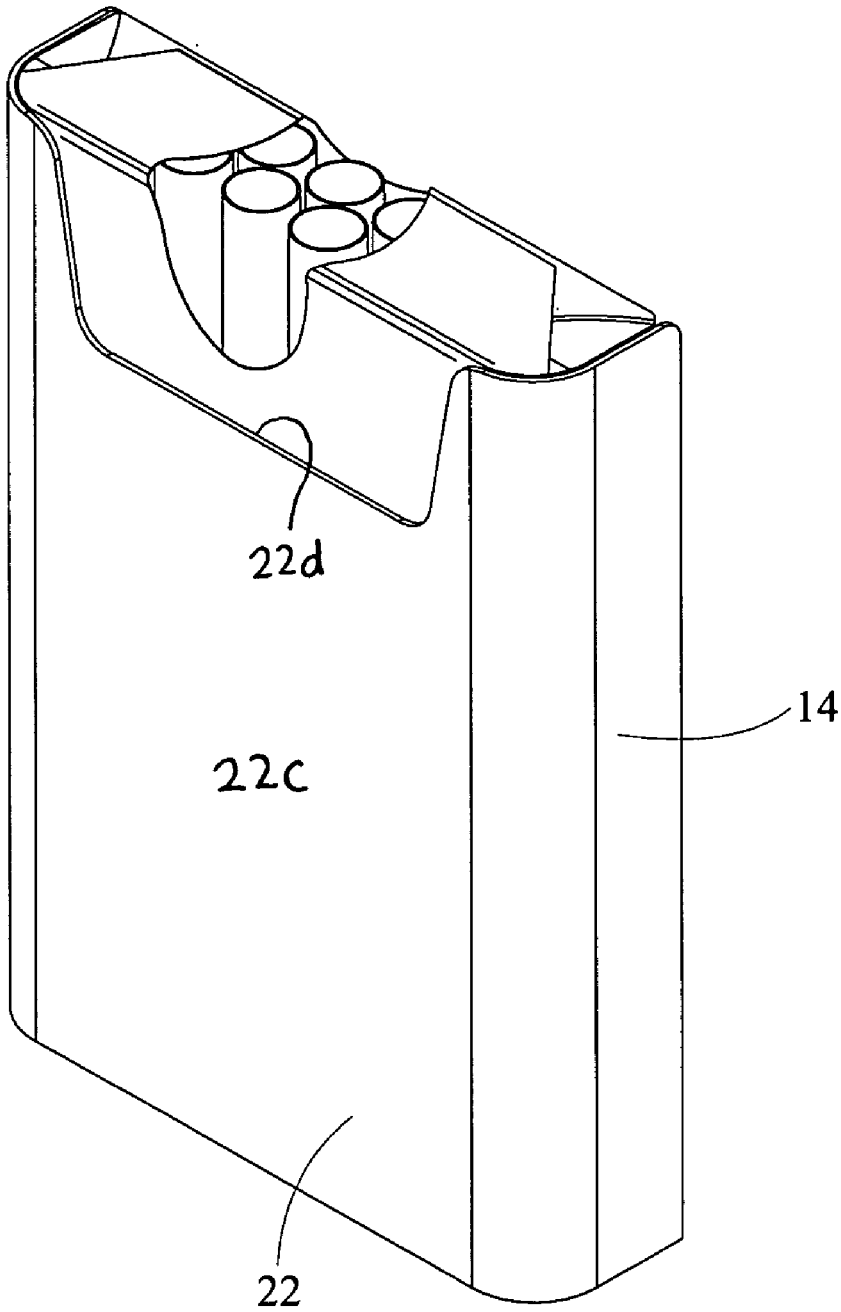
FIG. 3 is a perspective partial cut away view of the second foil wrapped bundle formed by the cigarette wrapping machine of the present invention.

HLP2 31 can be utilized, as is set forth herein, to make a thirteen cigarette bundle 14, shown in FIGS. 1 and 3. HLP2

Figure 9:
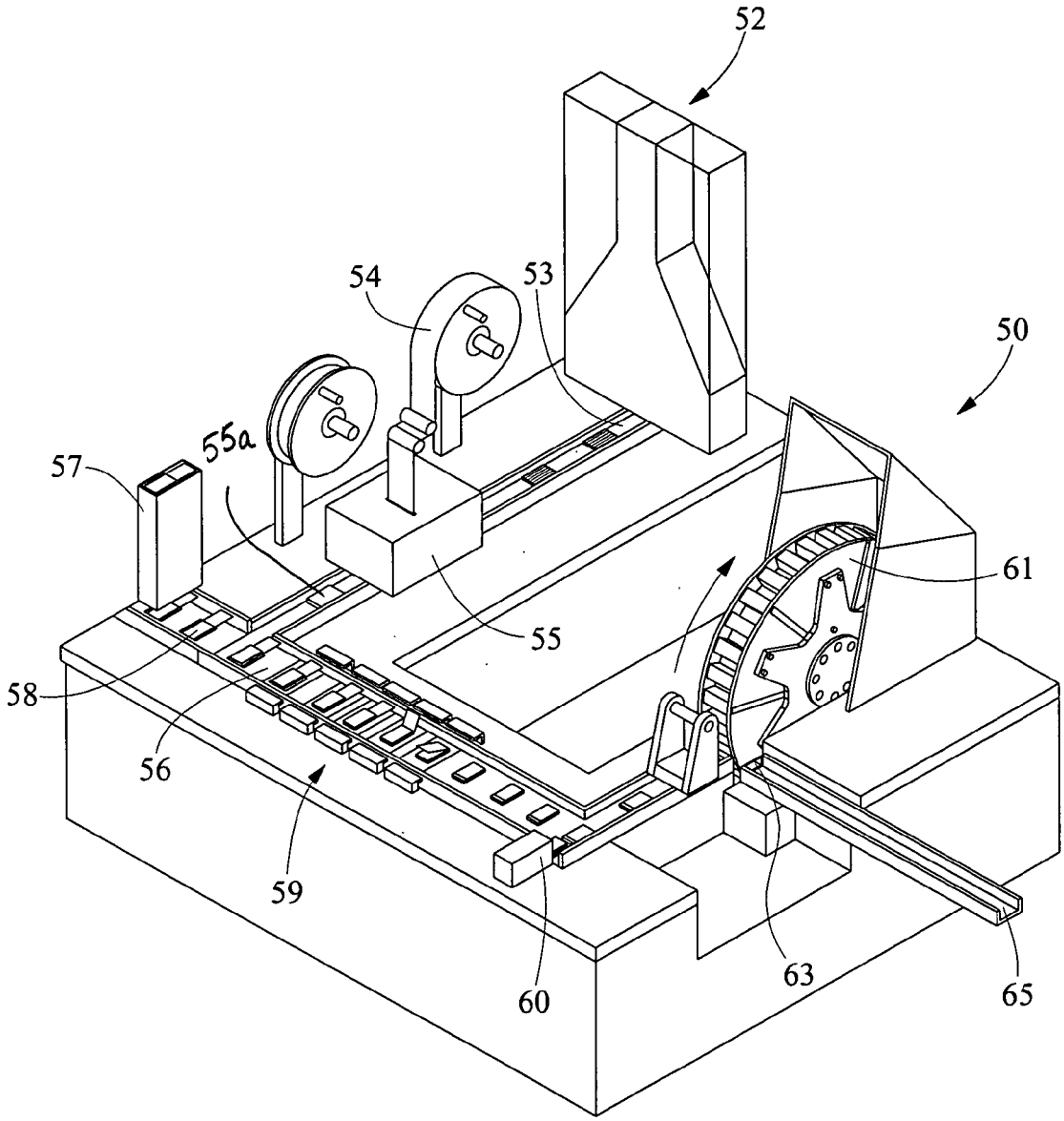
FIG. 9 is a top perspective view of the cigarette wrapping machines of the present invention for creation of the separate foil inner frame wrapped bundles.
Figure 10:
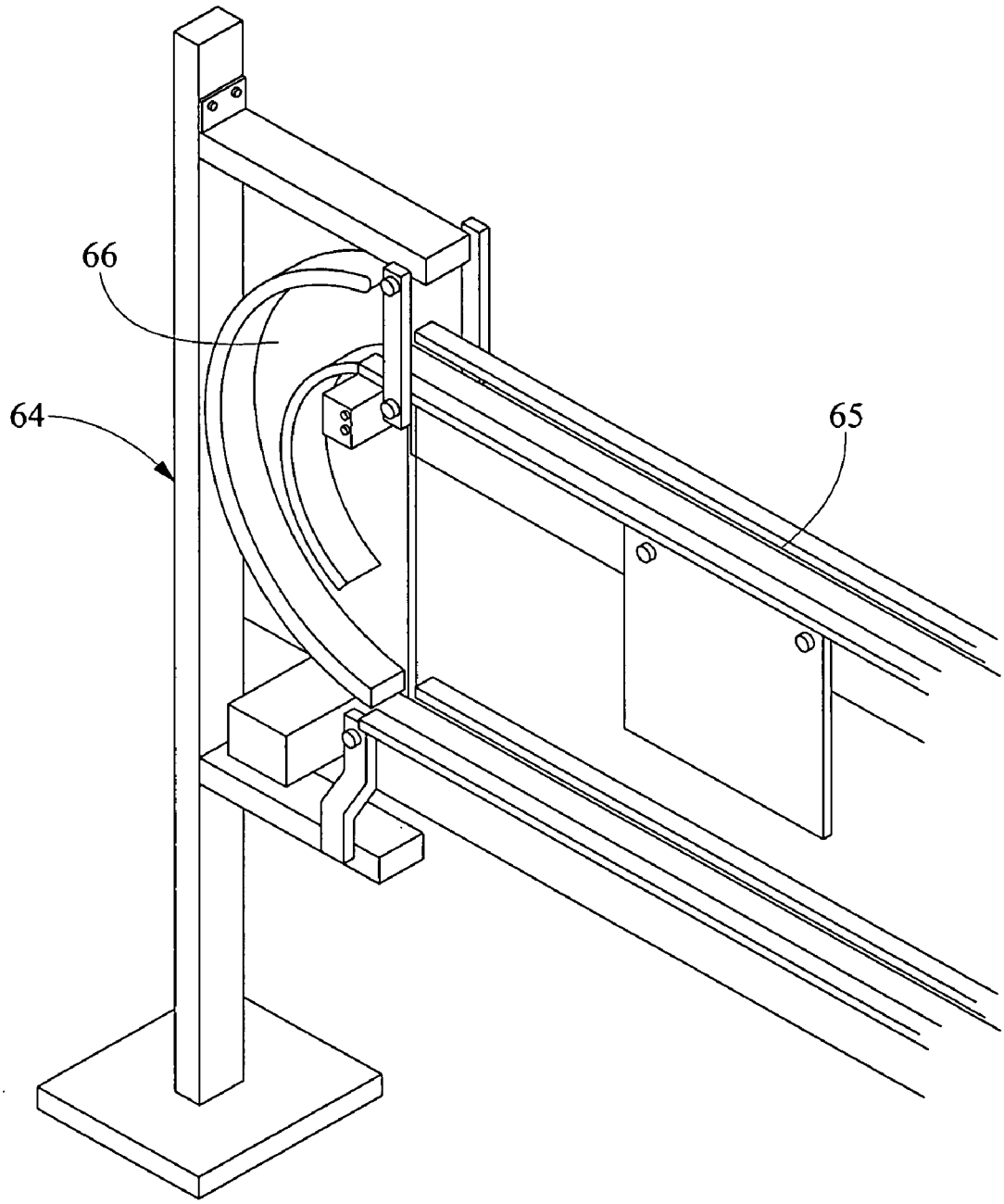
FIG. 10 is a perspective view of the inverting station for one of the exit conveyors of the present invention.

31 creates the thirteen cigarette bundle 14 by first placing six and seven stacked cigarette rows together on a cigarette alignment conveyor 53, shown in FIG. 9, wrapping the stacked cigarettes with foil 54 and then surrounding the foil with an inner frame 22 for an exemplary thirteen cigarette bundle 14.

Similarly, HLP1 30 can be utilized to form a single row of seven cigarettes, wrap these cigarettes in foil lining 16, place this seven cigarette bundle onto the blank conveyor which are then partially surrounded by the inner frame 23 for the seven cigarette bundle 12.

Both of the inner frame wrapped cardboard bundles 12, 14 are axially aligned as inner frame cartons and are then wrapped in an outer frame 26 in HLP3 32. Thus, after manufacturing of both the thirteen's cigarette bundle and the seven's cigarette bundle packs, both bundles are forwarded to HLP3 32 and are combined with the outer frame or outer carton member 26 which is folded around the two foil wrapped bundles 12, 14, glued at the proper seams, and then cut along the bottom panel 27 so that it may open along the vertical hinge line 16*b* at the side.

In operation, both HLP1 30 and HLP2 31 work very similarly for creation of the first and a second foil wrapped cigarette bundle 14, 16. Thus, explanation for the cigarette wrapping machines herein applies to each machine. Referring to FIG. 9, cigarettes are fed to the cigarette wrapping machine 50 through a cigarette intake chute 52. The cigarettes are aligned by the alignment conveyor 53 to prepare the cigarettes for individual bundle formation. Foil wrap 54 is fed from a spool or bobbin for wrapping of the cigarette bundle in a foil wrap station 55. The cigarette bundle may be formed in either a 7 or 13 bundle as previously indicated in the present pack design but many other alternative constructions and cigarette counts are readily available for use in the present hinged lid pack design.

The cigarette bundle is forwarded by the cigarette alignment conveyor 53 to the foil wrapping station 55 where foil 54 is unrolled off of a foil roll suspended from above such that the cigarette bundle is wrapped appropriately in foil. The foil wrapped bundle 55*a* is then forwarded to the inner frame blank conveyor 56. In the blank conveyor 56 are located individual stations which receive cigarette carton blanks 58 from the inner frame blank chute 57. Prior to a foil wrap bundle 55*a* being inserted into the individual station on the blank conveyor 56 having a blank inserted therein, a small dot of adhesive may be applied to a front flat planar surface so that the cigarette bundle 55*a* remains stationary thereon. After placement of the foil bundle 55*a* into the individual blank 58 in the blank conveyor 56, the folding operations begin for folding of the inner frame blank 58 around the foil bundle 55*a*. A second dot of adhesive may be placed on the opposing flat surface of the inner frame blank 58 to secure the foil wrapped bundle 55*a* within the inner frame 58. After placement of the second adhesive dot on the interior wall of the inner frame, the inner frame 58 is folded around the foil wrapped bundle 55*a* in the folding and adhesive application stations 59 and the formed inner frame foil wrapped cigarette bundle is passed through an inspection station where improperly folded inner frame members are rejected. After the inspection station, the individual packs are passed by the conveyor which moves the foil wrapped bundle from the individual stations of the blank conveyor 56 to a drum application of adhesive so that an adhesive is applied to the long side seams for the folding operation of the sides or seams. After the long sides are folded, the now formed inner frame with the foil lined cigarette bundle (12, 14) located therein is passed into the drying drum 61 by the plunger 60 which allows the long side seam adhesive to dry before the pack is removed from the drum 61 and passed to an exit conveyor 65 through an exit aperture 63 formed in the drum 61. Thus, subsequent to the drying drum 61, the fully formed inner frame cigarette bundles, 12 and 14 depicted in FIGS. 2 and 3, are positioned properly and ready for advancement to cigarette wrapping machine HLP3 32 for creation of the outer frame and hinged lid of the pack.

Figure 5:
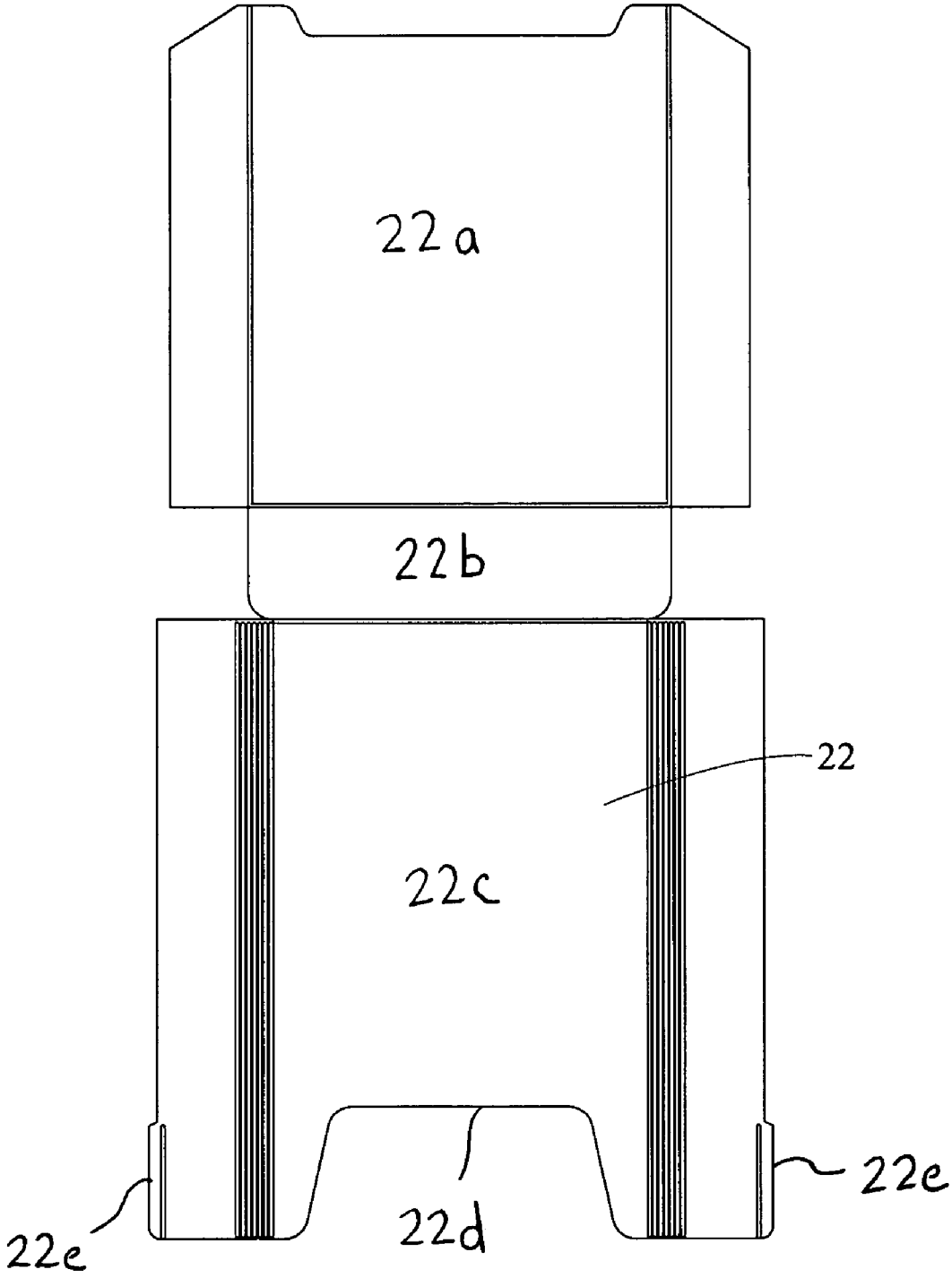
FIG. 5 is a plan view of one of the inner frame members used by the cigarette wrapping machine of the present invention for creating one of the foil wrapped bundles.

In both the first cigarette wrapping machine 30 and second cigarette wrapping machine 31, HLP1 and HLP2, the system generally utilizes the same process for formation of the individual cigarette foil wrapped bundles, namely the seven cigarette bundle and the thirteen cigarette bundle. The cigarettes are funneled into the wrapping machine and the inner frame is wrapped or formed there around. Each of the inner frame surrounded foil wrapped bundles 12 and 14, as shown in FIGS. 2 and 3, are formed with the respective inner frame blanks 22 and 23 shown in FIGS. 5 and 6. In FIG. 5, the thirteen's inner frame 22 is shown wherein an inner face member 22*a*, bottom wall 22*b* and outer face 22*c* is shown and is formed in the second cigarette wrapping machine 31 (HLP2). Further, a cutout 22*d* is also formed in the inner frame blank. As can be seen in the fully formed thirteen's pack 14 of FIG. 3, the inner frame 22 covers almost the entirety of the foil wrapped bundle of cigarettes. The cutout section 22*d* is formed such that the foil can be grasped from the outside wall of the pack 10 without the two individual bundles, 14 and 12, being separated about vertical hinge line 16*b*, shown in FIG. 1.

Figure 2:
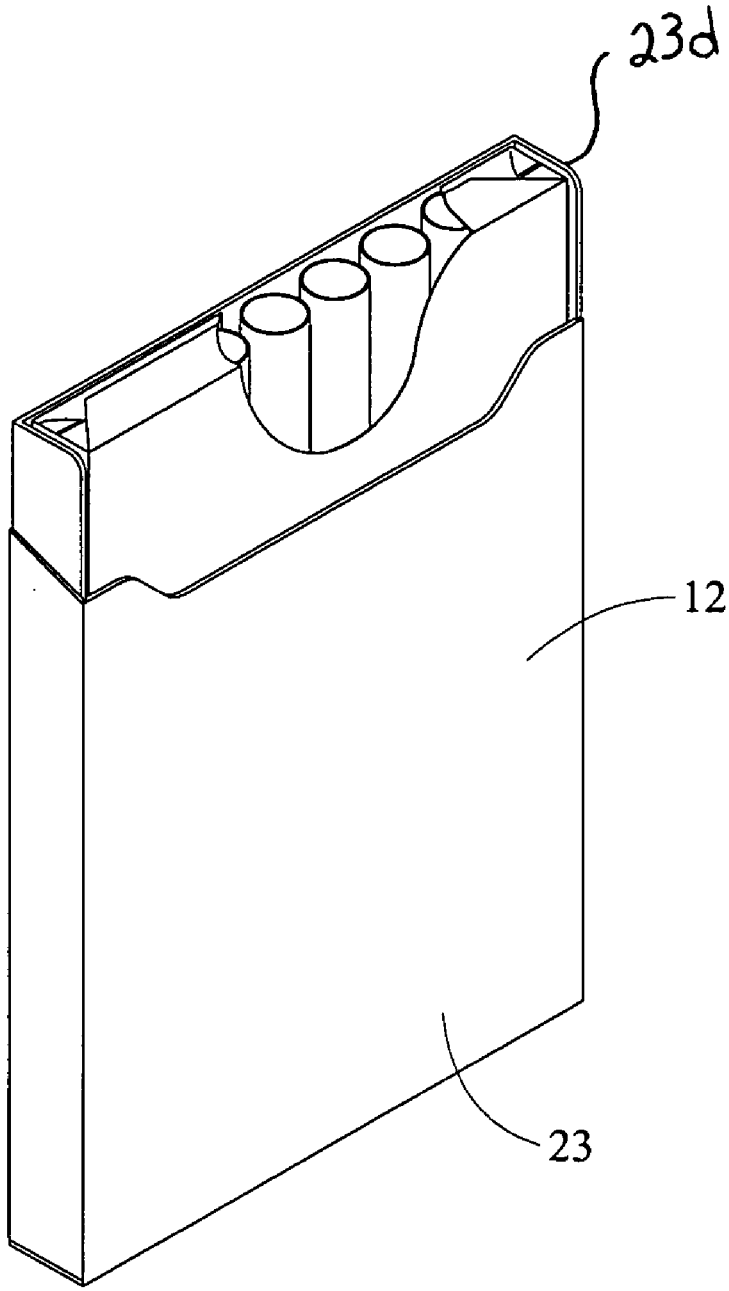
FIG. 2 is a perspective partial cut away view of the first foil wrapped bundle formed by the cigarette wrapping machine of the present invention.
Figure 4:
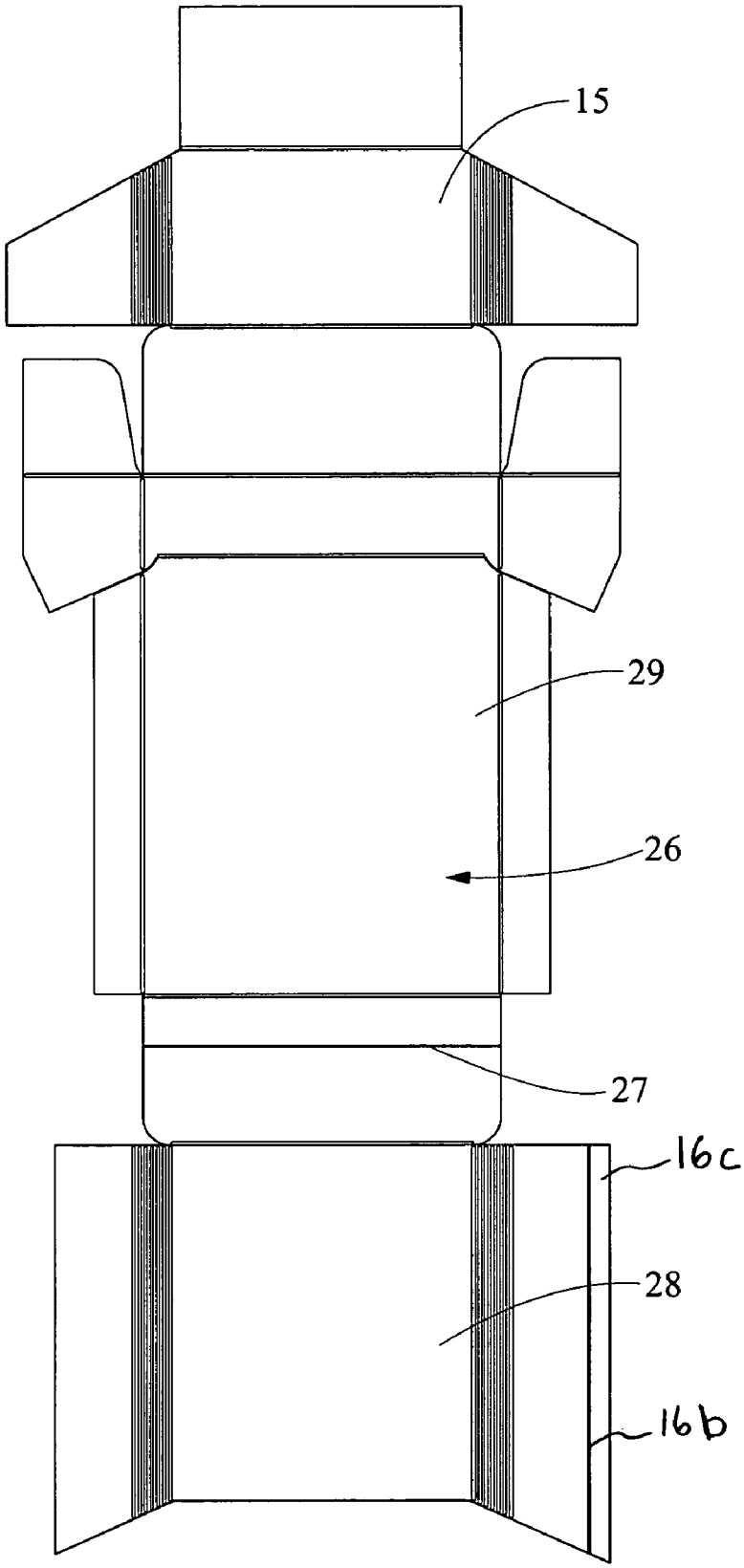
FIG. 4 is a plan view of the outer frame blank used by the cigarette wrapping machine of the present invention.
Figure 6:
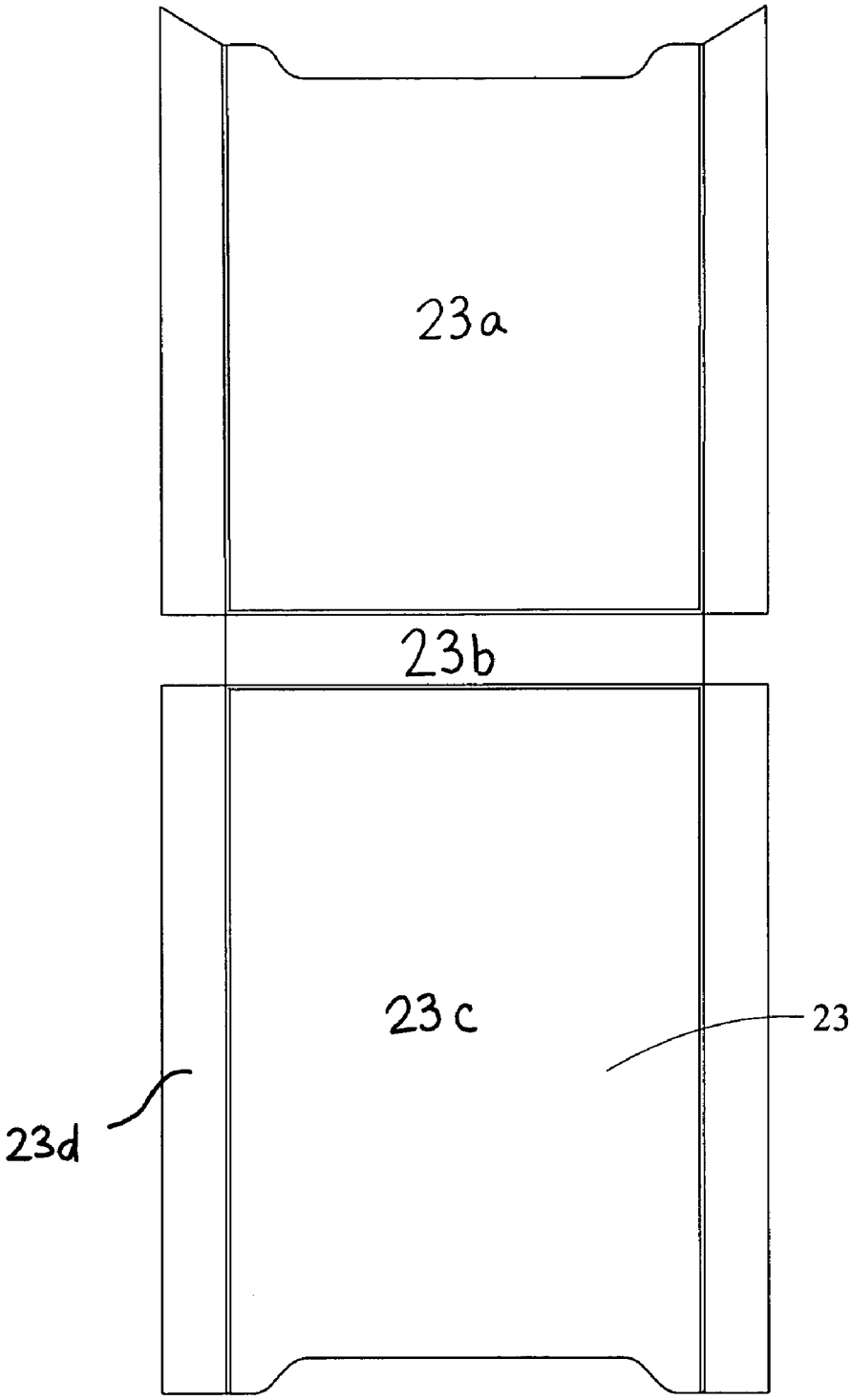
FIG. 6 is a plan view of the one of the inner frame members used by the cigarette wrapping machine of the present invention for creating one of the foil wrapped bundles.

Likewise, the seven's cigarette bundle or pack 12, shown in FIG. 2, is formed in the first cigarette wrapping machine 30 (HLP1). The inner frame 23 is shown in FIG. 6 wherein the inner frame 23 for the bundle pack 12 is formed of an inner face 23*a*, bottom wall 23*b* and an outer face 23*c*. Sidewall 23*d* is also shown and is constructed so as to adhesively receive the hinge panel 16*c* of the outer frame 26, shown in FIG. 4. Thus, after the two foil wrapped bundles are formed, 12 and 14, they are placed in front to front abutting relationship and then wrapped in the third cigarette wrapping machine 32 by the outer frame 26, shown in FIG. 4.

The outer frame 26 manipulated by the third cigarette wrapping machine 32 has a cover 29, hinged lid section 15, score or cut line on the bottom wall 27, outer face 28, vertical hinge line 16*b* and hinge panel 16*c*. The third cigarette wrapping machine folds the cover or rear panel 29 about the outer face 23*c* of the seven's inner frame 23 and also forms the hinged lid 15. The bottom wall 27 is folded around the combined bottom walls of the seven's inner frame 23*b* and the bottom wall 22*b* of the thirteen's inner frame. The outer face 28 is adhesively applied to the outer face 22*c* of the thirteen's inner frame 22 while the hinge panel 16*c*, as mentioned, is adhesively applied to the side wall 23*d* of the seven's inner frame 23. By so constructing and folding the outer frame 26 around the face to face combined packs 75, shown in FIGS. 11 and 12, the pack 10 of the present invention may be hinged about the vertical hinge line 16*b* allowing the pack to be opened as depicted in FIG. 1. It can also be appreciated that the bottom wall 27 of the outer frame must be appropriately cut so that it can separate as seen and depicted. It is further appreciated that any number of cigarettes in the individual bundles 14 and 12 may be utilized so as to create the vertically hinged pack 10 of the present invention.

Figure 11:
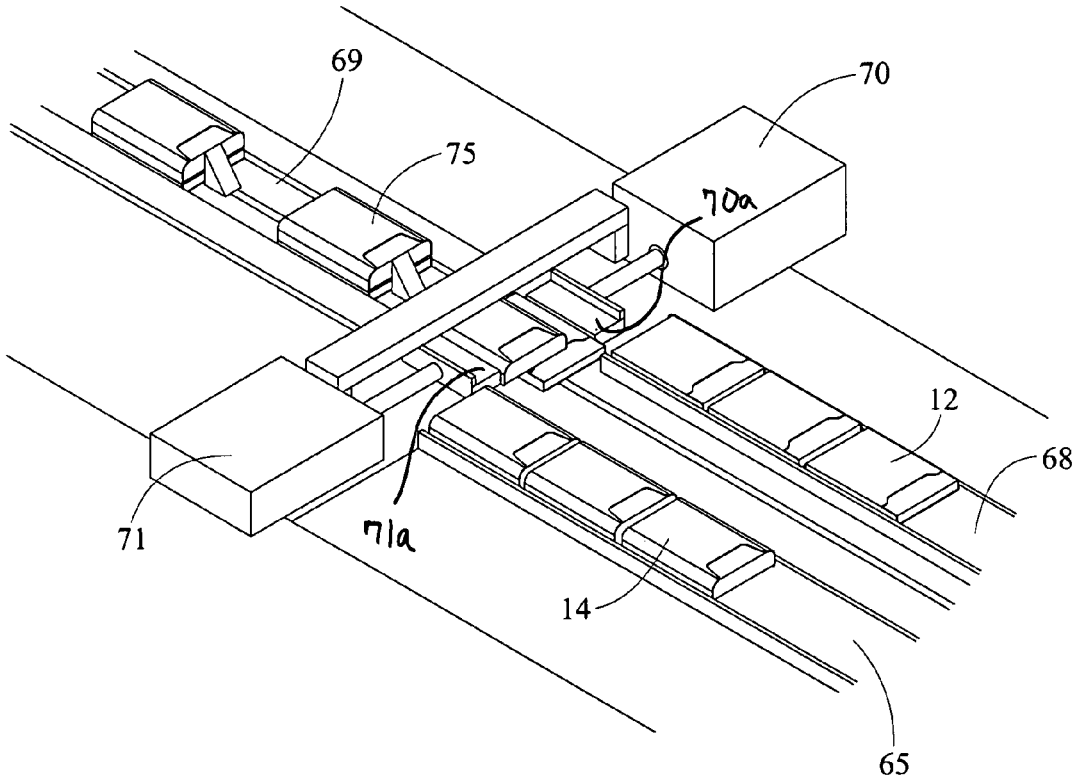
FIG. 11 is a perspective view of the combination station of the present invention for combining the separate foil wrapped bundles into a single bundle.
Figure 12:
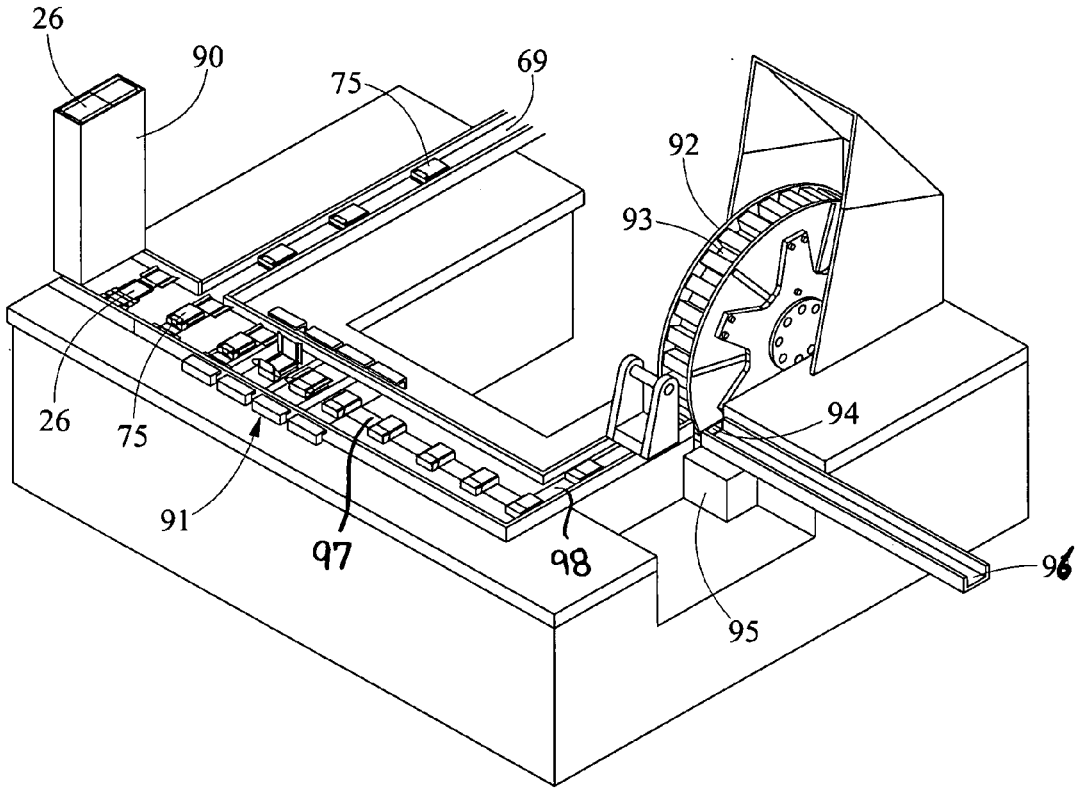
FIG. 12 is a perspective view of the cigarette wrapping machine used for creation of the outer frame in the present invention.

In the HLP2 machine 31, the finished cigarette bundle 14 with the wrapped carton of inner framed material there-around is inverted on the conveyor at an inverting station 64, shown in FIG. 2, so the that the packs are properly aligned face to face. The conveyor turn 66 is formed to flip the pack appropriately prior to the HLP 3 machine so that the packs 12, 14, when combined as depicted in FIG. 11 as combined packs 75, are in face to face relationship on the combined conveyor 69.

The two exit conveyors 65 and 68 representing exit conveyors from the first and second cigarette wrapping machine 30, 31 are placed in side-by-side relationship as they enter into the combination station. As can be understood, one of the conveyors must be displaced vertically from the other conveyor so that as the plungers 70*a* and 71*a* are activated to remove the bundles 12, 14 from each of the conveyors 68 and 65, they are in proper vertical alignment so that they may slide over one another to form the combined cigarette pack 75. Plungers 70*a*, 71*a* activated by actuators 70, 71, are activated from either side of both conveyors 65, 68 to combine the cigarette bundles in face-to-face relationship for subsequent wrapping by the outer carton blank 26. The combined bundles 75 are then passed into HLP3 32 where they are passed onto the individual stations of the blank conveyor 97 containing the outer frame carton 26. The combined bundles 75 are then packaged by the third cigarette wrapping machine 32 as previously mentioned so that the outer frame member 26 provides a vertical hinge line 16*b* between the two separate bundles 12, 14.

In the HLP3 machine 32, a number of glue application nozzles are provided in the folding and adhesive stations 91. These glue application nozzles may be HHS spray nozzles for spot gluing on the HLP3 blank conveyor 97. This adhesive is similar to the normal adhesive utilized except that it is more viscous for ready application through the nozzles. Multiple application or nozzles are required in HLP3 machine 32, approximately 6 in all, for spot application of adhesive to the various corners and positions on the outer frame member 26.

In regards to the outer frame member 26, the outer frame is designed to partially surround the two inner frame wrapped foil lined cigarette bundles 14, 12, while also having a score line along the bottom wall 27 thereof which may be cut so that the formed vertically hinged pack 10 may open along the necessary hinge line 16*b* at the side edges. Thus, upon examination of the outer frame blank 26, a small score line may be provided at the vertical hinge line 16*b*.

The combined bundles 75 are passed into the blank conveyor 97 of the third cigarette wrapping machine 32 (HLP3) as indicated and the adhesive is applied to the appropriate positions, folding operations are conducted so that the tops and sides are folded appropriately surrounding the two bundles 14, 12, while applying adhesive at the appropriate positions. An examination station may also be provided in the HLP3 machine in order to examine each package to ensure that the folding operations and adhesive operations have taken place in the folding and adhesive stations 91 and, where appropriate, reject cartons which are identified and then removed from the HLP3 machine 32.

A transfer conveyor 98 is located at the opposite end of the blank conveyor 97 for moving the formed vertical hinged cigarette package 10 across an adhesive drum for the long side seam adhesive application, along the side panels such as 16*c*, after which the combined and fully formed hinged lid vertically hinged cigarette package 10 is placed into individual pockets 93, similarly as in HLP 1 and HLP2, of the drying drum 92. At the end of the rotational extent or drying duration of the drying drum 92 and just before the exit aperture 94, a rotary knife or other cutting mechanism 95 may be provided for cutting along the score line or full panel of the bottom wall 27 of the outer frame member 26 or for direct cutting of the full bottom flap. The pack is then forced from the pocket 93 of the drum 92 and moved again to receive another pack. The cutting of the bottom wall 27 is necessary so that the individual cigarette pack 10 may be hinged about the side walls along hinge line 16*b* and may separate at the now cut bottom wall 27. At the exit 94 of the drying drum 92, the individual packs 10 are removed for later handling and placement into cigarette cartons.

In the HLP3 machine 32, all of the folding operations necessary for formation of the outer pack or outer frame is provided. This includes folding of the hinged lid 15 lid and folding the lid over the closed but individually separated cigarette bundles 14, 12.

The HLP1 machine 30 and HLP2 machine 31 are initially designed to run at about 140 packs per minute. The foil wrapping system for both HLP 1 and HLP2 are standard twin foil reel holders with typical rotary cut off and foil perforation units. The foil lining 16 is perforated as is normally conducted using a straight cut knife or serrated knife so that the upper exposed section on both bundles 14, 12, of the foil may be removed by the user. In relation to the blank folding and adhesive stations 59 provided along the blank conveyor 56 of both HLP1 and HLP2, standard plough folders and top panel reciprocating folders are utilized. Fold tabs 22*e* may also be placed at the top of the opposing side walls on the outer face 22*c* of the inner frame 22 in order to help maintain the hinged lid 15 in closed position. These folding tabs 22*e* are placed on the inner frame member 22.

The drying drums 61 and 92 utilized in all three machines 30, 31, 32, are forty-eight stage heated drums which are temperature controlled to assure proper drying of the adhesive in the formed packs.

The system of the present invention combines 3 pieces of machinery, a first cigarette bundle making machine 30, a second cigarette bundle making machine 31 and a third combined outer wrapping machine 32. The system of the present invention provides for creation of two inner frame foil wrapped bundles of cigarettes 14, 12, which are combined in a third wrapping machine 32 that provides an outer frame making apparatus. The first cigarette packing machine 30 creates a foil wrap cigarette bundle surrounded by a first inner frame member 23. The second cigarette packing machine 31 creates a second foil wrapped bundle wrapped in a second inner frame 22. The first inner frame 23 and the second inner frame 22 are subsequently combined into a face to face combined pack 75. In the present example, the second inner frame 22 can contain seven cigarettes and six cigarettes combined for a thirteen cigarette bundle pack 14 while the other cigarette packing machine can create a seven cigarette foil wrapped bundle 12 surrounded by the first inner frame member 23. Both inner frames with the foil wrap cigarette bundles are then fed into a outer frame carton folding machine 32 which combines the two bundles into a side hinged pack having a hinged lid.

The three machine cigarette packer of the present invention is controlled by a standard operable controlling device such as a PLC or similar electronic controller mechanism for controlling the transfer speeds and production speeds of all three packers. Such electronic controllers are known in the art and various electronic arrangements and embodiments may be utilized to effectuate control of the individual packers set forth herein.

It is apparent that variations to the different cigarette makers are available while still using concepts of the present invention disclosed herein and claimed. Such variations are deemed to fall within the teachings and claims of the present application.

We claim:

1. A method of forming a hinged lid side-by-side vertically hinged cigarette pack, comprising:

forming a first foil wrapped bundle of cigarettes having a first inner frame member;

forming a second foil wrapped bundle of cigarettes having a second inner frame member;

transporting said first foil wrapped bundle and said second foil wrapped bundle to a wrapping machine in combined relationship;

partially surrounding said combined first foil wrapped bundle in said second foil wrapped bundle with an outer frame;

adhesively applying a vertical hinge panel of said outer frame to said first foil wrapped bundle; and cutting said outer frame to thereby allow said combined first foil wrapped bundle and said second foil wrapped bundle to hinge about a vertical hinge line on said outer frame.

2. The method of claim 1 wherein cutting said outer frame comprises cutting a bottom panel of said outer frame in half to allow said first foil wrapped bundle and said second foil wrapped bundle to separate about said hinge line.

3. A method of forming a multiple bundle hinged cigarette pack comprising:

forming a seven cigarette bundle;

wrapping said seven cigarette bundle in foil;

creating a seven cigarette bundle inner frame carton containing said seven cigarette bundle;

forming a thirteen cigarette bundle;

wrapping said thirteen cigarette bundle in foil;

creating a thirteen cigarette bundle inner frame carton containing said thirteen cigarette bundle;

conveying said thirteen cigarette bundle inner frame carton and said seven cigarette bundle inner frame to a combining station;

combining said thirteen cigarette bundle inner frame carton and said seven cigarette carton in face-to-face relationship to form a combined cigarette bundle;

forming an outer frame over said combined cigarette bundle;

adhering a hinge panel on said outer frame to one of said thirteen or said seven cigarette bundle inner frame carton; and cutting said outer frame such that said thirteen and said seven cigarette bundle inner frame cartons are allowed to hinge relative to each other about a vertical hinge line on said outer frame.

4. A cigarette packing machine for creation of separate foil wrapped bundles, comprising:

a first and a second cigarette packing machine, said first cigarette packing machine creating a first foil wrapped cigarette bundle surrounded by a first inner frame, said second cigarette packing machine creating a second foil wrapped cigarette bundle surrounded by a second inner frame;

a third cigarette packing machine, said third cigarette packing machine receiving said first foil wrapped cigarette bundle and said second foil wrapped cigarette bundle in face-to-face overlaying relationship, said third cigarette packing machine partially surrounding said first and said second foil wrapped cigarette bundle with an outer frame, said outer frame having a hinge line along a mating side edge of said first cigarette foil wrapped bundle and said second cigarette foil wrapped bundle; and a cutting mechanism for cutting said outer frame along a mating bottom edge of said first cigarette foil wrapped bundle and said second cigarette foil wrapped bundle.

5. The cigarette packing machine of claim 4 wherein said first cigarette packing machine and said second cigarette packing machine each have a cigarette receiving station, a foil wrapping station, an inner frame blank conveyor, a transferring conveyor and a drying drum.

6. The cigarette packing machine of claim 4 wherein said third cigarette packing machine has a conveyor transfer station having a first transfer plunger and a second transfer plunger, said first plunger crossing a conveyor line from said first cigarette packing machine, said second plunger crossing a conveyor line from said second cigarette packing machine, both said first and said second plunger depositing cigarette packs onto a combination conveyor.

7. An apparatus for forming a multiple bundle hinged lid cigarette pack, comprising:

a first cigarette bundle wrapping machine forming a first bundle of cigarettes wrapped in a first inner frame and having a foil wrapping station and blank chute adjacent a blank conveyor, a drying drum and a first exit conveyor;

a second cigarette bundle wrapping machine forming a second bundle of cigarettes wrapped in a second inner frame and having a foil wrapping station, a blank chute adjacent a blank conveyor, a drying drum and a second exit conveyor;

a conveyor combination station receiving said first exit conveyor and said second exit conveyor; and, a third cigarette bundle wrapping machine forming the multiple hinged lid cigarette pack and having a combined bundle conveyor, an outer frame chute holding a plurality of outer frames adjacent a blank conveyor, a drying drum and a cutting mechanism.

8. The apparatus for forming a multiple bundle hinge lid cigarette pack of claim 7 wherein said second exit conveyor has an inverting station.

9. The apparatus of claim 7 wherein said first bundle of cigarettes contain seven cigarettes.

10. The apparatus of claim 7 wherein said second bundle of cigarettes contain thirteen cigarettes.

11. The apparatus of claim 7 wherein said first exit conveyor and said second exit conveyor meet at a first and a second actuator adjacent said combined bundle conveyor.

12. The apparatus of claim 11 wherein said first actuator has a plunger that sweeps across said first exit conveyor and said second actuator has a plunger that sweeps across said second exit conveyor.

13. The apparatus of claim 12 wherein said first bundle of cigarettes and said second bundle of cigarettes are positioned face-to-face on said combined bundle conveyor.

14. The apparatus of claim 7 wherein said cutting mechanism is positioned adjacent an exit of said drying drum on said third cigarette wrapping machine.

15. The apparatus of claim 14 wherein said cutting mechanism slits a bottom panel of said outer frame.

16. The apparatus of claim 7 wherein said outer frame forms a hinged lid for said multiple bundle hinged lid cigarette pack.

17. The apparatus of claim 7 wherein said first bundle of cigarette wrapped in a first inner frame and said second bundle of cigarettes wrapped in a second inner frame are in hinged side-by-side relationship in hinge about a vertical hinge line.

18. An apparatus for making a hinged lid side-by-side hinged cigarette pack comprising:

a first cigarette machine producing a first foil wrapped bundle, said first cigarette wrapping machine having a foil wrapping station, an inner frame blank chute for holding a first inner frame, a blank conveyor, a drying drum and an exit conveyor adjacent said drying drum;

a second cigarette wrapping machine producing a second foil wrapped bundle, said second cigarette wrapping machine having a foil wrapping station, an inner frame blank chute for holding a second inner frame, a blank conveyor, a drying drum and an exit conveyor adjacent said drying drum;

said first cigarette wrapping machine exit conveyor and said second cigarette wrapping machine exit conveyor ending at a conveyor combination station having a first actuator adjacent said first cigarette wrapping machine exit conveyor and a second actuator adjacent said second cigarette wrapping machine exit conveyor;

a combination conveyor at said conveyor combination station and entering into said third cigarette wrapping machine;

said third cigarette wrapping machine receiving said combined conveyor, said combined conveyor ending at an outer frame chute for holding an outer frame, said outer frame chute adjacent a blank conveyor on said third conveyor cigarette wrapping machine, said third cigarette wrapping machine further having a drying drum and a cutting mechanism adjacent said drying drum.

19. The apparatus of claim 18 wherein said first foil wrapped cigarette bundle has seven cigarettes.

20. The apparatus of claim 18 wherein said second foil wrapped bundle of cigarettes has thirteen cigarettes.

21. The apparatus of claim 18 wherein said second cigarette wrapping machine exit conveyor has an inverting turn.

22. The apparatus of claim 18 wherein said combination station combine said first foil wrapped bundle and said second foil wrapped bundle in layered face-to-face relationship.

23. The apparatus of claim 18 wherein said first cigarette wrapping machine wraps said first foil wrapped bundle in said inner frame, said second cigarette wrapping machine wraps said second foil wrapped bundle in said second inner frame.

24. The apparatus of claim 23 wherein said outer frame forms a hinged lid and has a hinge line vertically connecting said first foil wrapped cigarette bundle and said second foil wrapped cigarette bundle.

25. A cigarette packing machine for creating separate foil wrapped bundles and forming a hinged lid side-by-side hinge pack comprising:

a first cigarette wrapping machine having means for forming a first foil wrapped bundle with a first inner frame;

means for forming a second foil wrapped bundle with a second inner frame;

a combination conveyor receiving said first foil wrapped bundle and said second foil wrapped bundle in face-to-face layered relationship;

a third cigarette wrapping machine wrapping an outer frame around said first foil wrapped bundle and said second foil wrapped bundle such that they hinge along a vertical hinge line by adhering a hinged panel of said outer frame on a side panel of said first foil wrapped bundle and cutting said outer frame to allow said first and said second foil wrapped bundles to hinge.

26. The packing machine of claim 25 wherein said means for forming a first foil wrapped bundle include a first inner frame chute adjacent a first inner frame blank conveyor, a plurality of folding stations and a drying drum.

27. The cigarette packing machine of claim 26 wherein said means for forming a first foil wrapped bundle further includes a cigarette intake chute and a foil wrapping station.

28. The cigarette packing machine of claim 25 wherein said means for forming a second foil wrap bundle with a second inner frame includes a second inner frame chute adjacent a second inner frame blank conveyor, a plurality of folding stations and a drying drum.

29. The cigarette packing machine of claim 28 wherein said means for forming a second foil wrapped bundle with a second inner frame further includes a cigarette intake chute and a foil wrapping station.

30. The cigarette packing machine of claim 25 wherein said first foil wrapped bundle has seven cigarettes.

31. The cigarette packing machine of claim 25 wherein said second foil wrapped bundle has thirteen cigarettes.

* * * * *